US005802811A

United States Patent [19]

Danzig

[11] Patent Number: 5,802,811

[45] Date of Patent: Sep. 8, 1998

[54] METHOD AND APPARATUS FOR DISPENSING BABY BIBS

[76] Inventor: Jan Quinn Danzig, S. 6322 Gaiser Ct., Spokane, Wash. 99223

[21] Appl. No.: 844,725

[22] Filed: Apr. 18, 1997

Related U.S. Application Data

[60] Provisional application No. 60/016,240, Apr. 19, 1996.

[51] Int. Cl.[6] ..... B65B 63/04

[52] U.S. Cl. ..... 53/429; 53/447; 2/49.2

[58] Field of Search ..... 2/49.1, 49.2, 49.3, 2/49.4, 49.5; 53/117, 429, 447

[56] References Cited

U.S. PATENT DOCUMENTS

| | | |
|---|---|---|
| 2,763,867 | 9/1956 | Chagnon . |
| 3,001,646 | 9/1961 | Cooper . |
| 3,229,875 | 1/1966 | Stoller . |
| 3,299,440 | 1/1967 | Grable . |
| 3,583,558 | 6/1971 | Davis . |
| 3,851,760 | 12/1974 | Smith . |
| 4,423,523 | 1/1984 | Bodner et al. . |
| 4,840,270 | 6/1989 | Caputo et al. . |
| 4,884,299 | 12/1989 | Rose . |
| 5,100,710 | 3/1992 | Rizzuto . |
| 5,491,844 | 2/1996 | Kehl et al. . |
| 5,530,968 | 7/1996 | Crockett . |

*Primary Examiner*—Daniel Moon
*Attorney, Agent, or Firm*—David S. Thompson

[57] ABSTRACT

A method and apparatus for dispensing baby bibs is disclosed. The apparatus includes a container, such as a bag, envelope, pouch or box, defining an opening sized to allow withdrawal of a single bib at a time. The bib is folded in a novel manner, and is then carried by the container such that the opening in the container is in a location adjacent to a folded cuff at the base of the bib. The method of dispensing the baby bibs allows the user to withdraw a single bib by grasping it by the apron or cuff and withdrawing it.

8 Claims, 3 Drawing Sheets

METHOD AND APPARATUS FOR DISPENSING BABY BIBS

CROSS-REFERENCES

This application is a continuation in part of a provisional patent application, having application number 60/016,240 and filing date Apr. 19, 1996 now abandoned.

BACKGROUND

A large number of bibs for use in catching food dropped by small children are known. Most provides a front apron and two upper ties that allow the bib to be supported about the neck with the apron covering the chest.

Additionally, a large number of disposable bibs are available. These bibs are known to be packaged in consumer packaging wherein a number of bibs are stacked together, and then the group of bibs folded in half or quarters, and then boxed. Alternatively, for institutional sales it is known to provide bibs on a roll, in a manner similar to paper towels.

In spite of the advances in bib packaging, a packaging apparatus providing a method for conveniently dispensing a single bib with a minimum of time and effort by the consumer has yet to be developed. Current packaging methods require the consumer to unbox and unfold a number of bibs, remove one bib, and then re-fold and repackage the remaining bibs.

SUMMARY

The present invention is directed to a method and apparatus for dispensing baby bibs that satisfies the above needs. The method includes the following steps:

(a) Folding a bib about a first lengthwise one-third fold line. A fully unfolded bib, having a lower cuff fully visible, is folded in a lengthwise manner so that only two-thirds of the bib is visible after the fold.

(b) Folding the bib about a second lengthwise one-third fold line. A second fold is the mirror image of the first fold. The center one third of the bib is visible after the fold.

(c) Folding the bib about a first widthwise one-third fold line. In this fold, an upper one-ninth portion of the bib, including the tie strings, is folded underneath the center one-ninth portion of the bib. Approximately two-ninths of the bib is visible after the fold.

(d) Folding the bib about a second widthwise one-third fold line, whereby a cuff portion and an apron portion of the bib is visible. In this fold, the visible two-ninths of the bib are folded in half, and the resulting folded bib is positioned so that the cuff portion is visible.

(e) Folding a plurality of bibs in a similar manner.

(f) Stacking the plurality of bibs, each bib having the cuff portion oriented in a like manner.

(g) Enclosing the stacked plurality of bibs in a container having an opening or means to make an opening, such as perforations, through which a cuff portion and an apron portion of the bib are visible or accessible.

It is therefore a primary advantage of the present invention to provide a novel method and apparatus for dispensing baby bibs wherein a plurality of bibs are arrayed within a container for convenient removal by an end consumer one-by-one.

Another advantage of the present invention is to provide a novel method and apparatus for dispensing baby bibs wherein each bib may easily be removed from the container by hooking a cuff portion of the bib with a finger and pulling.

A still further advantage of the present invention is to provide a novel method and apparatus for dispensing baby bibs wherein the stacked plurality of folded bibs within the dispensing container may be folded in an interlocking manner, whereby each bib removed causes an adjacent bib to be moved partially out of the container in a manner that makes its later removal more convenient.

DRAWINGS

These and other features, aspects, and advantages of the present invention will become better understood with regard to the following description, appended claims, and accompanying drawings where:

Figure 4:
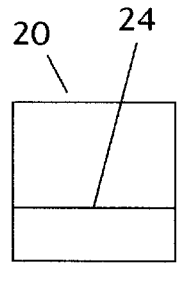
Figure 1:
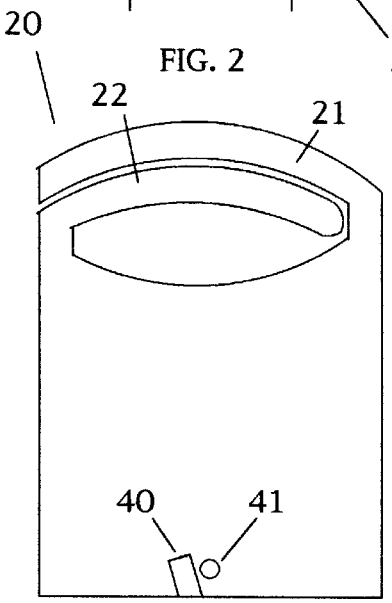
FIG. 1 is a isometric view of a type of bib usable with the method and apparatus of the invention, wherein the bib is fully unfolded and supported on a flat surface, and where the bib provides a tab and a hole, typically used in the alternative, for removing a bib from a package of bibs.
Figure 5:
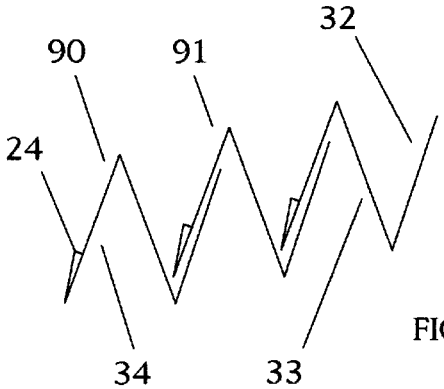
Figure 6:
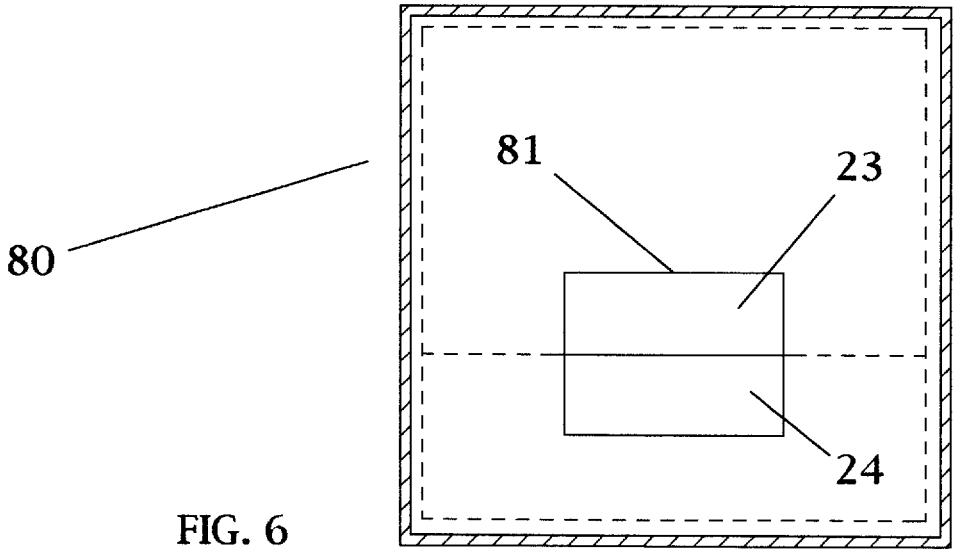
Figure 7:
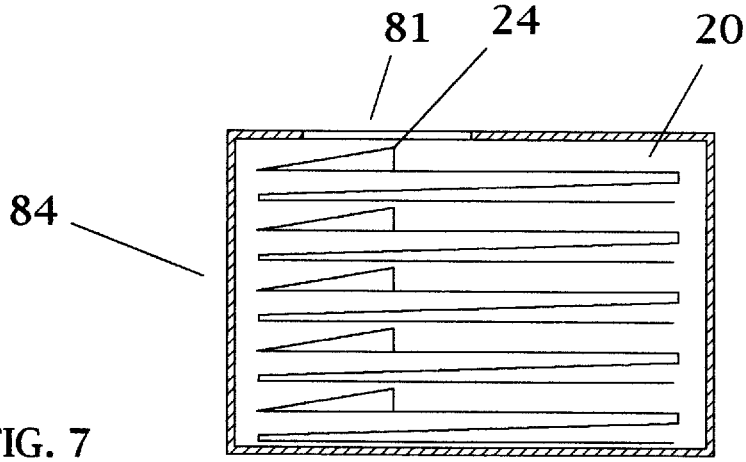
Figure 8:
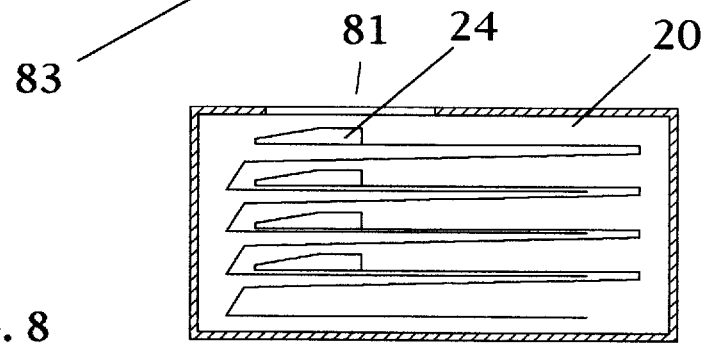
Figure 9:
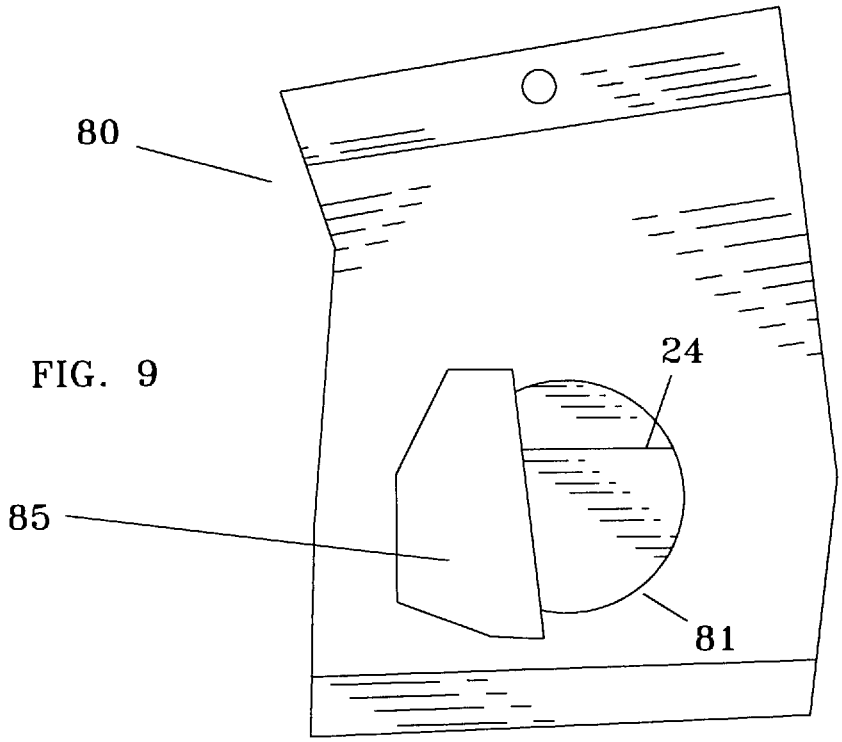
Figure 10:
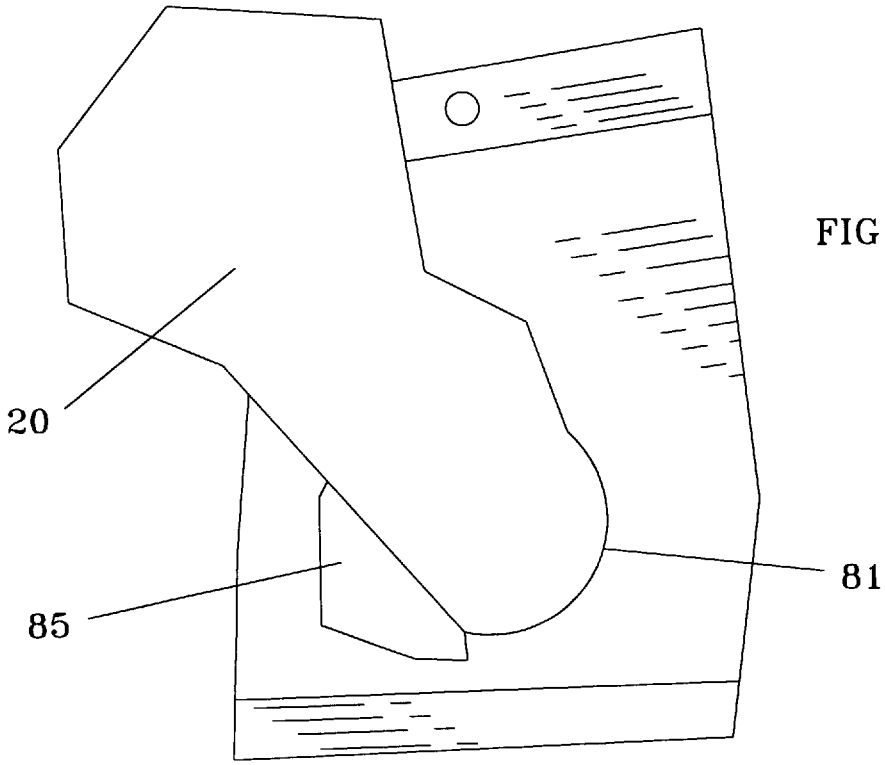

FIG. 4 is a view of the bib of FIG. 1, wherein upper and middle one-ninth portions of the bib have been folded about the first and second widthwise one-third fold lines, and are then carried under the lower one-ninth portion FIG. 5 is a somewhat diagrammatic view of three folded bibs illustrating how a plurality of bibs may be arrayed in an interlocking manner, whereby dispersement of a first bib will reposition a second bib advantageously for dispersement;

FIG. 6 is a top isometric view of a container having a dispensing opening through which a portion of the bib's apron and a portion of the bib's cuff are visible;

FIG. 7 is a side cross-sectional view of a container housing a plurality of folded bibs, showing in particular how the cuff portion is adjacent to the opening in the container;

FIG. 8 is a side cross-sectional view of a container housing a plurality of folded bibs, showing in particular how the bibs may optionally be interlocked, as seen in FIG. 5;

FIG. 9 is an isometric view illustrating a pouch container having a partially opened resealable closure mechanism, and illustrating a portion of a bib and a portion of the bib's cuff; and FIG. 10 is an isometric view illustrating a bib having been partially removed from the pouch container of FIG. 9.

DESCRIPTION

Referring generally to the figures, a method and associated apparatus for dispensing baby bibs constructed in accordance with the principles of the invention is seen. A plurality of bibs 20 are individually folded in a manner that results in the bib's apron 23 and cuff 24 being positioned as seen in FIG. 4. The bibs are then stacked, as seen in FIGS. 7 and 8, for storage within a container 80 defining an opening 81 exposing or providing manual assess to a small portion of the apron and/or cuff, as seen in FIG. 6.

As seen in FIG. 1, a bib 20 typically provides left and right ties 21, 22 and an apron body 23. The apron body additionally provides a lower cuff 24, which is a fold of material that tends to collect dropped food particles.

Such bibs are known to be made in a disposable version, and it is with this type of bib that the instant invention is related.

Figure 2:
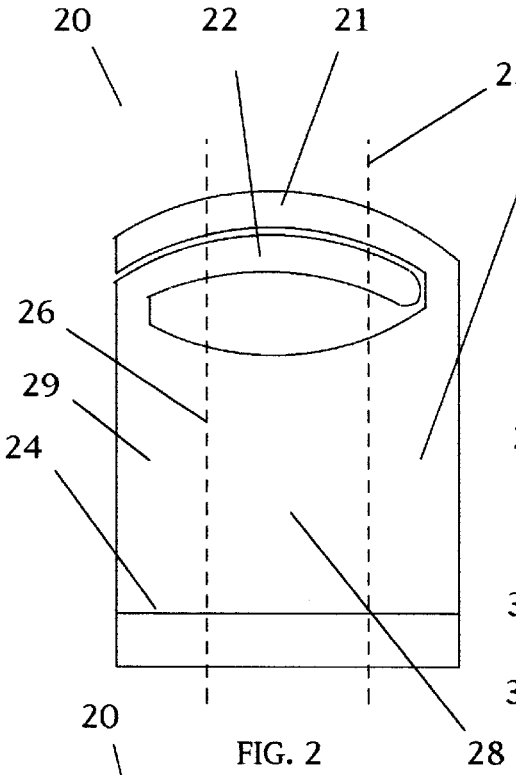
FIG. 2 is an isometric view of the bib of FIG. 1, having a first and second lengthwise one-third fold lines illustrated.

Referring to FIG. 2, left and right lengthwise one-third fold lines 25, 26 illustrate the location of the first and second folds made on the bib. The left side 27 is folded under the center portion 28 along fold line 25. The right side 29 is folded under the center portion along fold line 26. After these two folds are made, the bib appears as shown in FIG. 3.

Figure 3:
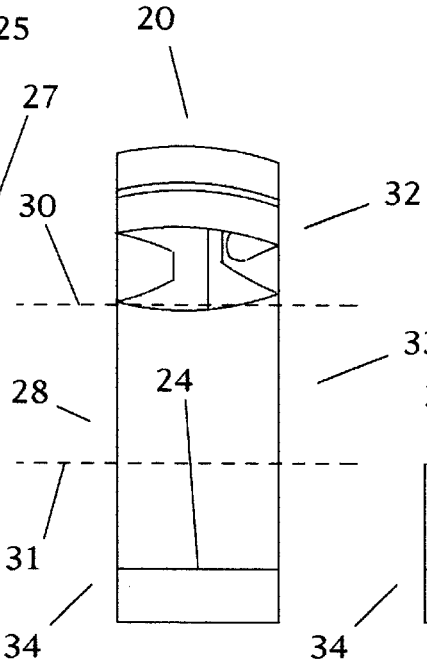
FIG. 3 is a view of the bib of FIG. 1, wherein left and right portions of the bib have been folded under the center portion about the first and second lengthwise one-third fold lines and first and second widthwise one-third fold lines are illustrated.

Continuing to refer to FIG. 3, upper and lower widthwise one-third fold lines 30, 31 illustrate the location of the third and forth folds made on the bib. The upper one-ninth 32 is folded under the middle one-ninth 33 along fold line 30. The remaining bib is the folded about lower widthwise one-third fold line 31. After the third and forth folds are made, the bib appears as shown in FIG. 4, having a portion of the apron 23 and a portion of the cuff 24 visible.

Referring to FIGS. 6 through 10, a container 80 may take the form of a box, bag or envelope. FIGS. 6 through 8 illustrate a box type container, while FIGS. 9 and 10 illustrate a bag or envelope type container. A container such as that disclosed by U.S. Pat. No. 4,840,270 to Caputo et al. is one type of suitable container, and that patent is hereby incorporated by reference. Alternatively, the container may be a cylindrical, particularly where the bibs are interlocked, as seen in FIGS. 5 and 8. In all cases, however, the container provides a top portion 82 defining an opening 81, sides 84 and a bottom 83. The opening 81, as seen in particular in FIG. 6 and 9, allows access to a portion of the apron 23 and cuff 24, allowing the end consumer to pull out a single bib, as seen in FIG. 10. The opening may have a closure mechanism, such as a flap 85, which allows the container to be re-sealed. The opening may alternatively be formed by perforations, thereby allowing the end consumer to tear the perforations, forming the opening.

As seen in FIG. 5, a number of the folded bibs of FIG. 4 may be interlocked in a manner that causes a first bib 90, as it is removed from the container 80, to pull a second bib 91 into a position wherein it is more easily removed from the container.

As seen in FIG. 5, the lower one-ninth 34 of a second bib is sandwiched between the middle one-ninth 33 and the upper one-ninth 32 of a first bib. A plurality of bibs, interlocked in this manner, may be stored in a container 80, as seen in FIG. 8.

In a version of the invention using bibs having an apron and ties but no cuff, the bibs are folded as seen above. However, in this version of the invention, only a portion of the apron is visible or assessable through the opening 81. As a result, the user will pull on the apron, rather than the cuff, to release one of the bibs.

Where no cuff is available, a tab 40 or hole 41, may optionally be used to replace the functionality of the cuff, in that a user may pull a bib from the container by grasping the tab or hole. Typically, the tab or hole would be used in the alternative; however, both are illustrated on the same bib in FIG. 1 for purposes of convenience only. The hole is typically sized so that one finger may be inserted. This allows easy removal of one bib.

The previously described versions of the present invention have many advantages, including a primary advantage of providing a novel method and apparatus for dispensing baby bibs wherein a plurality of bibs are arrayed within a container for convenient removal by an end consumer one-by-one.

Another advantage of the present invention is to provide a novel method and apparatus for dispensing baby bibs wherein each bib may easily be removed from the container by hooking a cuff portion of the bib with a finger and pulling.

A still further advantage of the present invention is to provide a novel method and apparatus for dispensing baby bibs wherein the stacked plurality of folded bibs within the dispensing container may be folded in an interlocking manner, whereby each bib removed causes an adjacent bib to be moved partially out of the container in a manner that makes its later removal more convenient.

Although the present invention has been described in considerable detail and with reference to certain preferred versions, other versions are possible. Therefore, the spirit and scope of the appended claims should not be limited to the description of the preferred versions disclosed.

The invention resides not in any one of these features per se, but rather in the particular combination of all of them herein disclosed and claimed and is distinguished from the prior art in this particular combination of all of its structures and steps performed for the functions specified.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of packaging baby bibs, the baby bibs having a lengthwise direction and a perpendicularly oriented widthwise direction, the method of folding the baby bibs comprising:

(a) folding a bib having an apron and a cuff about a plurality of fold lines, whereby a portion of the apron and a portion of the cuff of the folded bib is exposed;

(b) repeating step (a) for a plurality of bibs;

(c) stacking the plurality of bibs; and (d) enclosing the stacked plurality of bibs in a container having an opening through which the exposed portion of the cuff and the exposed portion of the apron of one of the bibs is graspable by a user through the opening.

2. The method of packaging baby bibs of claim 1, additionally comprising:

(a) stacking the plurality of bibs in an interlocking manner.

3. The method of packaging baby bibs of claim 1, additionally comprising:

(a) folding the plurality of bibs so that a hole, defined in the apron of each bib, is exposed when the bib is adjacent to the opening in the container.

4. The method of packaging baby bibs of claim 1, additionally comprising:

(a) folding the plurality of bibs so that a tab, carried by the apron of each bib, is exposed when the bib is adjacent to the opening in the container.

5. A method of packaging baby bibs, the baby bibs having an apron and a cuff, wherein the cuff is oriented in a widthwise manner and a lengthwise direction is oriented perpendicularly to the widthwise direction, wherein the method of folding the baby bibs comprises:

(a) folding a bib about a first lengthwise one-third fold line;

(b) folding the bib about a second lengthwise one-third fold line;

(c) folding the bib about a first widthwise one-third fold line;

(d) folding the bib about a second widthwise one-third fold line, whereby a portion of the cuff and a portion of the apron of the bib are exposed;

(e) repeating steps (a), (b), (c) and (d) for a plurality of bibs;

(f) stacking the plurality of bibs, wherein the exposed portion of the cuff of each bib is oriented a spaced distance from the exposed portion of the cuff of the adjacent bib; and (g) enclosing the plurality of bibs in a container having an opening through which the exposed portion of the cuff and the exposed portion of the apron of one of the bibs is graspable by a user through the opening.

6. The method of packaging baby bibs of claim 5, additionally comprising:

(a) stacking the plurality of bibs in an interlocking manner.

7. The method of packaging baby bibs of claim 5, additionally comprising:

(a) folding the plurality of bibs so that a hole, defined in the apron of each bib, is exposed when the bib is adjacent to the opening in the container.

8. The method of packaging baby bibs of claim 5, additionally comprising:

(a) folding the plurality of bibs so that a tab, carried by the apron of each bib, is exposed when the bib is adjacent to the opening in the container.

* * * * *